United States Patent [19]

Hatje

[11] 4,020,733

[45] May 3, 1977

[54] PAGE TURNING DEVICE

[75] Inventor: Carl H. J. Hatje, Rexdale, Canada

[73] Assignee: The Raymond Lee Organization, Inc., a part interest

[22] Filed: May 6, 1976

[21] Appl. No.: 683,912

[52] U.S. Cl. ..... 84/503; 84/504; 84/506

[51] Int. Cl.[2] ..... G10G 7/00

[58] Field of Search ..... 84/503–506, 84/502

[56] References Cited

UNITED STATES PATENTS

| | | | |
|---|---|---|---|
| 229,554 | 7/1880 | Ramseyer | 84/503 |
| 626,192 | 5/1899 | Scott | 84/504 |
| 1,057,418 | 4/1913 | Gesking | 84/506 |

*Primary Examiner*—Stephen J. Tomsky

[57] ABSTRACT

A first horizontal elongated plate has a longitudinally extending slot therein. Each of a plurality of vertical L shaped members has a bottom horizontal leg disposed at right angles to the slot and an upwardly disposed vertical leg. Each of a like plurality of soft yieldable elements is manually slidable in the slot, each horizontal leg extending through a corresponding element and overlying the top surface of said first plate. A second horizontal plate is secured to the top surface of the first plate, said vertical legs being disposed adjacent one edge of the second plate, said first and second plates having regions spaced apart to permit said members to be slid back and forth along the slot. A third horizontal plate is secured to the first plate remote from said members, adjacent parallel edges of said second and third plates being spaced apart to define an opening parallel to said slot through which said vertical legs extend.

4 Claims, 4 Drawing Figures

PAGE TURNING DEVICE

SUMMARY OF THE INVENTION

This invention is directed towards a device which can be built in to the existing music holder on a piano or similar instrument to enable anyone playing the instrument to turn pages of music without appreciable interruption of play.

To this end, the device is constructed as follow. A first horizontal elongated plate having a longitudinally extending slot therein is secured to the piano adjacent and in front of the existing inclined support for sheet or book music.

Each of a plurality of vertical L shaped members has a bottom horizontal leg disposed at right angles to the slot and an upwardly disposed vertical leg. Each of a like plurality of soft yieldable elements is manually slidable in the slot, each horizontal leg extending through a corresponding element and overlying the top surface of said first plate.

A second horizontal plate is secured to the top surface of the first plate, said vertical legs being disposed adjacent one edge of the second plate said first and second plates having regions spaced apart to permit said members to be slid back and forth along the slot. The legs extend upward between the second plate and the holder. Before anyone starts to play, the music is disposed on the holder and the horizontal legs are moved back and forth so that the vertical legs are disposed between the pages to be turned.

Then during play, each horizontal leg is slid to the left of the user when and as required. This action moves the corresponding vertical leg to the left and causes the appropriate page to be turned as desired.

Figure 1:
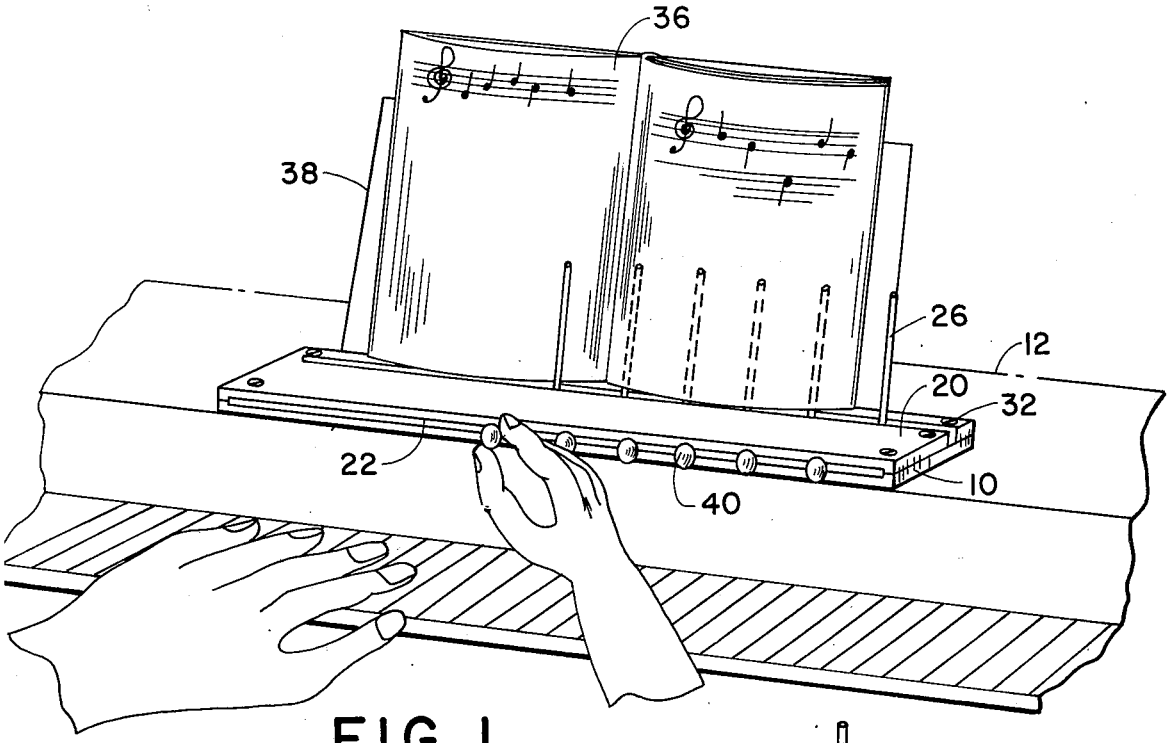
Referring now to FIGS. 1–4 a first flat horizontal elongated wooded plate 10 is secured to the piano 12 behind and above the keys. Plate 10 has a longitudinally extending slot 14 therein.
Figure 2:
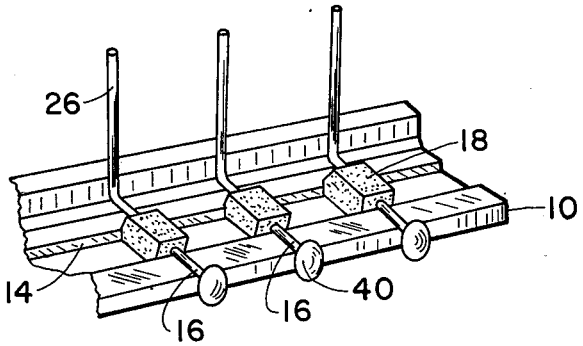
Figure 3:
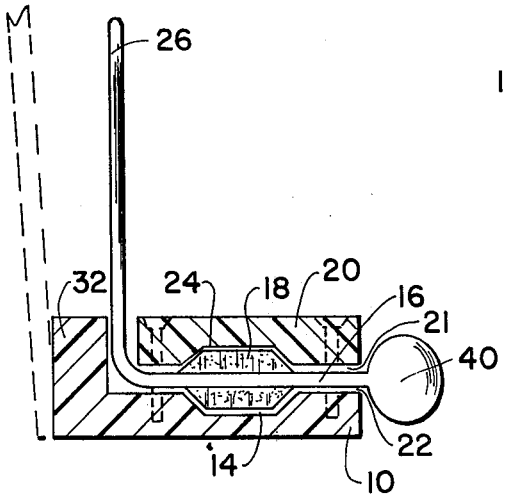
Figure 4:
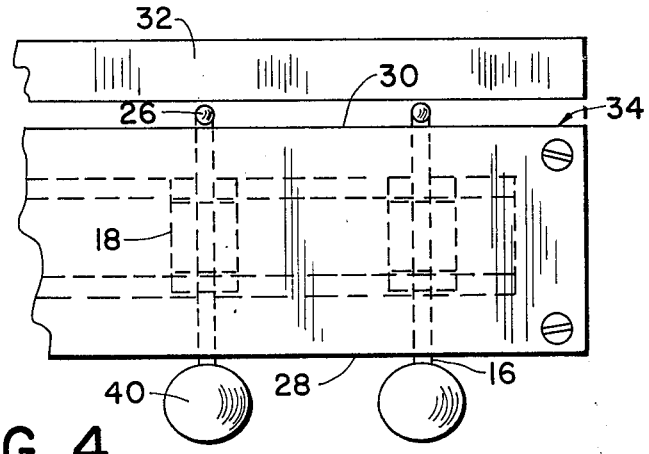

A plurality of L shaped members lying in parallel vertical planes disposed at right angles to the slot are employed. Each member has a bottom disposed horizontal leg 16 which is disposed at right angles to the slot and overlies the plate 10. Each leg 16 extends through a corresponding soft yieldable element 18 typically of felt which is slidable in the slot. The free end of each leg 16 is formed into an enlarged ball 40.

A second plate 20 overlies plate 10 and is secured thereto in such manner as to define spaced apart regions 22 therewith whereby the user by grasping ball 40 can slide the member to the left or right. Plate 20 can have a slot 24 similar to slot 14 but inverted to further accommodate the elements 18.

The balls 40 are disposed along the aligned front edges 28 of plates 10 and 20. The upright vertical legs 26 of the L shaped members extend past the rear edge 30 of plate 20. A third plate 32 can be secured to plate 10 adjacent plate 20 to define an elongated opening 34 being parallel to slot 14. Plate 32 can be integral with plate 10.

Music 36 can then be disposed in holder 38 and the pages turned as described.

While the invention has been described with particular reference to the drawings, the protection sought is to be limited only by the terms of the claims which follow.

I claim:

1. A page turning device comprising:

a first horizontal elongated plate having a longitudinally extending slot therein;

a plurality of vertical L shaped members, each member having a bottom horizontal leg disposed at right angles to the slot and an upwardly disposed vertical leg;

a like plurality of soft yeildable elements manually slidable in the slot, each horizontal leg extending through a corresponding element and overlying the top surface of said first plate; and a second horizontal plate secured to the top surface of the first plate, said vertical legs being disposed adjacent one edge of the second plate, said first and second plates having regions spaced apart to permit said members to be slid back and forth along the slot.

2. The device of claim 1 further including a third horizontal plate secured to the first plate remote from said members, adjacent parallel edges of said second and third plates being spaced apart to define an opening parallel to said slot through which said vertical legs extend.

3. The device of claim 2 wherein the free end of each horizontal leg is formed into an enlarged ball.

4. The device of claim 3 wherein the second plate carries on its inner surface an additional slot alogned with the slot in the first plate, said elements being slidable in the aligned slots.

* * * * *